United States Patent [19]

Deutschländer

[11] 3,959,952

[45] June 1, 1976

[54] PACKAGING APPARATUS USING HOSE-SHAPED WRAPPER

[75] Inventor: Gert Deutschländer, Neuhausen am Rheinfall, Switzerland

[73] Assignee: S I G Schweizerische Industrie-Gesellschaft, Neuhausen am Rheinfall, Switzerland

[22] Filed: Aug. 12, 1975

[21] Appl. No.: 603,508

[30] Foreign Application Priority Data

Aug. 27, 1974 Switzerland ..... 11682/74

[52] U.S. Cl. ..... 53/373; 53/180 R

[51] Int. Cl.[2] ..... B65B 9/06; B65B 51/26

[58] Field of Search ..... 53/180, 182, 373; 198/34

[56] References Cited

UNITED STATES PATENTS

| | | | |
|---|---|---|---|
| 3,402,524 | 9/1968 | Griner | 53/180 X |

FOREIGN PATENTS OR APPLICATIONS

| | | | |
|---|---|---|---|
| 376,047 | 4/1964 | Switzerland | 53/180 |
| 390,131 | 7/1965 | Switzerland | 53/180 |

*Primary Examiner*—Robert L. Spruill
*Attorney, Agent, or Firm*—Spencer & Kaye

[57] ABSTRACT

A packaging apparatus using a hose-shaped wrapper has a table on which the wrapper of indefinite length is advanced in the direction of its length. The wrapper contains uniformly spaced groups of articles to be packaged. The apparatus further has cooperating rotating welding shoes disposed in the path of travel of the wrapper for transversely bonding together wall portions of the wrapper between two article groups and endless chains formed of links and disposed above the table at both sides of the travelling path of the wrapper. Each chain has a chain portion extending adjacent and parallel to the travelling path of the wrapper along a length portion positioned upstream of the welding shoes as viewed in the direction of wrapper feed. A plurality of pressing members are secured to the chains at a predetermined distance; each pressing member on one chain cooperates with a pressing member on the other chain for pinching together the wrapper and supporting it laterally as it is fed through the welding shoes. Each pressing member includes a leading pressing finger and a trailing pressing finger, both affixed to a common unitary holder which, in turn, is pivotally secured to two successive chain joints. The leading pressing finger projects from the leading chain joint, which supports the associated holder to such an extent in the direction of wrapper feed as admitted by the distance between the chain-supporting sprocket closest to the welding shoes and the travelling path of the welding shoes.

2 Claims, 2 Drawing Figures a
b
1
2
3
4
5
5'
6
7
8
9
10
11
12
13
14
15
16
17
17'
17''
17'''
18
19
20
21
22

PACKAGING APPARATUS USING HOSE-SHAPED WRAPPER

BACKGROUND OF THE INVENTION

This invention relates to an apparatus for forming packages from a wrapper hose. The hose in which groups of flat articles to be packaged are uniformly spaced, is advanced to welding shoes which seal the hose by providing transverse seams between the groups. On both sides of the hose there are arranged circulating endless chains to which there are secured pairs of pressing fingers which pinch the hose between two article groups and which laterally support the hose during its motion in engagement with the welding shoes. The purpose of the chains equipped with the pressing fingers is to prevent the leading or trailing items of one item group from falling on their face within the hose; such an occurrence would lead to an interruption of the operation. Despite this known arrangement, such malfunctions occur in apparatuses constructed according to the prior art: sometimes the trailing items of a group fall shortly before the hose is grasped by the welding shoes behind such item.

SUMMARY OF THE INVENTION

The starting point of the invention is the recognition that the discussed undesired occurrence is based on the fact that heretofore each pressing finger has been secured to the chain by its own holding element and that for this reason the finger, in its compressing position, could not be brought close enough to the welding shoes.

It is an object of the invention to provide an improved apparatus of the above-outlined type from which the discussed disadvantage is eliminated.

This object and others to become apparent as the specification progresses are accomplished by the invention, according to which, briefly stated, the leading pressing finger and the trailing pressing finger forming one pressing member, are both affixed to a common, unitary holder which, in turn, is pivotally secured to two successive joints of the chain. The leading pressing finger projects from the leading chain joint, which supports the associated holder, to such an extent in the direction of wrapper feed as admitted by the distance between the chain-supporting sprocket closest to the welding shoes and the travelling path of the welding shoes.

DESCRIPTION OF THE PREFERRED EMBODIMENT

Figures 1, 2:
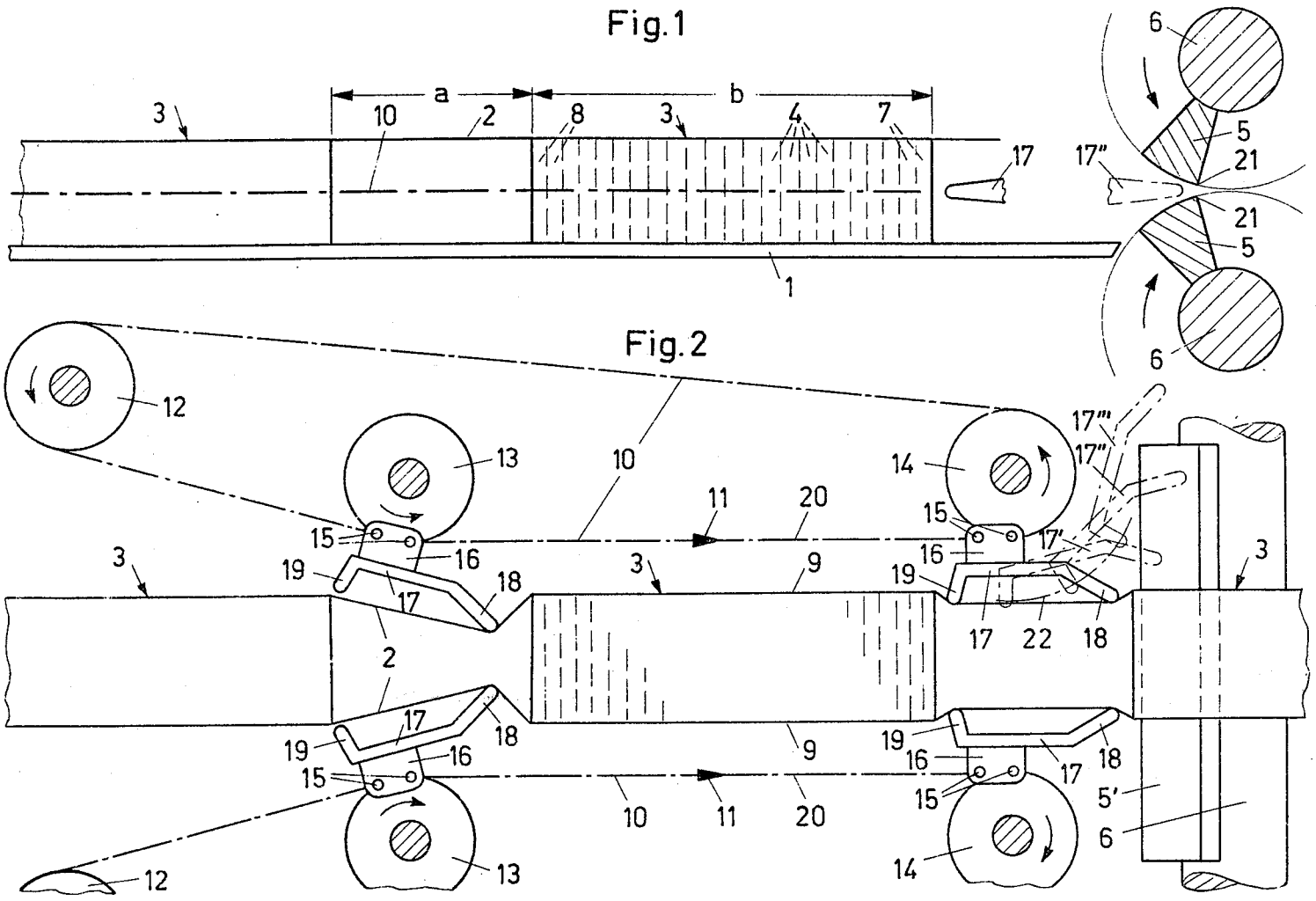
FIG. 1 is a schematic side elevational view of a preferred embodiment of the invention.
FIG. 2 is a schematic top plan view of the same embodiment.

Turning now to the Figures, the apparatus comprises a table 1 on which a hose-shaped wrapper 2 of indefinite length and of rectangular or round cross section is advanced in its longitudinal direction. This feed is effected, for example, in a conventional manner by means of feed rollers, not shown, which engage the hose along a longitudinal seam thereof, projecting through a slot of the table 1. Within the hose 2, at uniform distances *a*, there are positioned groups 3 formed of serially stacked flat items 4 to be wrapped.

The items 4, such as crackers or the like, stand edgewise. The length of each group 3 is designated with *b*. Between the groups 3 the hose 2 is to be squeezed together and the thus contacting upper and lower hose walls are to be bonded to one another by the provision of a transverse seam. For this purpose there are conventionally provided two oppositely rotating welding shoes 5 supported on shafts 6. The packages formed in this manner are still interconnected at their above-noted transverse seams which are severed by a cutter when the packages are to be separated.

In the absence of a safety device to be described below, the danger persists that the leading and/or trailing articles 7 and 8, respectively, may topple forwardly or backwardly within the hose 2. Such an occurrence would prevent the subsequent formation of transverse seams and thus would cause a serious operational disturbance.

The safety device for preventing the above-described occurrence has two endless chains 10 which are arranged symmetrically along opposite lateral walls 9 of the hose 2 and which run in an endless path in the direction indicated by the arrows 11. For guiding and driving the chains 10, there are provided, for each chain 10, three chain sprockets 12, 13 and 14. The chains 10 carry spaced pressing members 17 for pinching together the hose 2 between two groups 3. Each pressing member 17 is affixed to an associated holder 16 which, in turn, is articulated to two adjoining joints 15 of the chain 10. Each pressing member 17 has two pressing fingers 18 and 19 arranged serially in the longitudinal direction and each affixed to the same, unitary holder 16. The distance between the two pressing fingers 18 and 19 is significantly larger than the spacing between the two articulations of the holder 16 to the two consecutive joints 15. Further, the longitudinal distance of the leading pressing finger 18 from the leading joint 15 is several times greater than the distance of the trailing pressing finger 19 from the trailing joint 15. The chains 10 which are positioned at one-half the height of the hose 2 have, between the sprockets 13 and 14, portions 20 which extend parallel to the lateral walls of the hose 2 and thus parallel to the travelling path of the hose 2. Between the sprockets 12 and 13 the chains 10 approach the hose 2 in such a manner that at the sprocket 13 two oppositely located pressing members 17, with their fingers 18 and 19, press together the hose 2 between two successive groups 3. During this operation care has to be taken that the holders 16, the spacing of which on the chain 10 equals the sum of the distances *a* and *b*, engage the hose 2 at the correct moment between two groups 3. Along the chain course 20 the pressing fingers 18 and 19 have the same distance from the middle of the hose 2 and this condition prevails also when the leading one of the two adjoining chain joints 15 has run onto the sprocket 14. Subsequently, there occur positions 17', 17'', 17''', etc., of the pressing members 17 which are indicated in dash-dot lines at the upper sprocket 14 in FIG. 2.

In FIG. 1 the welding shoes 5 are illustrated in a position which they assume when the pressing member 17 has reached its position 17'. When the leading edges 21 of the welding shoes 5 press the oppositely located upper and lower hose walls on one another, whereby the welding operation starts, the pressing member 17 has already reached a position (approximately 17'') in which it does not obstruct the rotation of the welding shoes 5.

In FIG. 2, in which the upper shaft 6 is not shown, the position 5' of the welding shoe corresponds to that shown in FIG. 1, but the position of the groups 3 is depicted at an earlier moment of the rotational position of the welding shoes 5 in which the latter have not yet begun to engage the hose 2. It is thus seen that the leading pressure finger 18 of the pressing member 17 follows the rear end of the preceding group 3 and project forward into the zone of the welding shoes 5. Thus, the pressing member 17 of the invention more effectively prevents a toppling of the rear item 8 immediately at the welding shoes 5 than if the fingers 18 and 19 had been attached individually by separate identical holders to the chain 10, in which case they would move along an arcuate path 22. In such an event, although it would be possible to shift the sprocket 14 slightly towards the welding shoes 5, the leading pressing finger would release the hose much earlier (in order to prevent contact with the welding shoes 5) than in case of the described device. It has to be noted in this connection that the welding shoes 5 are, in a transverse direction of the hose 2, longer than it would be necessary for the illustrated width of the hose. In this manner wider hoses may also be handled by the device without the necessity of installing other welding shoes which have a wider work range.

It is to be understood that the travelling speed of the wrapper 2 and the chains 10 as well as the rpm of the welding shoes 5 are coordinated in a simple manner conventional by itself (e.g. by a gearing connection) to ensure that, on the one hand, the pressing members 17 travel in unison with the wrapper 2 along the length portion 20 of the chains 10 and, on the other hand, the welding shoes 5 engage the wrapper 2 always between two article groups 3.

It will be understood that the above description of the present invention is susceptible to various modifications, changes and adaptations, and the same are intended to be comprehended within the meaning and range of equivalents of the appended claims.

What is claimed is:

1. In a packaging apparatus using a hose-shaped wrapper, including a table on which the wrapper of indefinite length is advanced in the direction of its length, the wrapper containing uniformly spaced groups of articles to be packaged; cooperating rotating welding shoes disposed in the path of travel of the wrapper for transversely bonding together wall portions of the wrapper between two article groups; endless chains formed of jointed links and disposed above the table at both sides of the travelling path of the wrapper; each chain having a chain portion extending adjacent and parallel to the travelling path of the wrapper along a long portion positioned upstream of the welding shoes as viewed in the direction of wrapper feed; sprockets for driving and supporting the chains for effecting a travel of the pressing members that is codirectional with the wrapper feed along the chain portion; a plurality of pressing members secured to the chains at a predetermined distance; each pressing member on one chain cooperates with a pressing member on the other chain for pinching together the wrapper and supporting it laterally as it is fed through the welding shoes; each pressing member includes two pressing fingers; the improvement comprising a unitary holder provided for each pressing member; the pressing fingers of each pressing member being affixed to the unitary holder; said holder being pivotally secured to two successive chain joints, one of said successive chain joints being a leading joint and the other being a trailing joint; one of said two pressing fingers of each pressing member being a leading pressing finger and the other being a trailing pressing finger; said leading pressing finger projecting from the leading chain joint supporting the associated holder to such an extent in the direction of wrapper feed as admitted by the distance between the sprocket closest to the welding shoes and the travelling path of the welding shoes.

2. A packaging apparatus as defined in claim 1, wherein, in each pressing member, the distance of the leading pressing finger from the associated leading chain joint is several times the distance of the trailing pressing finger from the associated trailing chain joint.

* * * * *